US010248036B2

(12) United States Patent
Mori

(10) Patent No.: US 10,248,036 B2
(45) Date of Patent: Apr. 2, 2019

(54) POSITIVELY CHARGEABLE TONER

(71) Applicant: KYOCERA Document Solutions Inc., Osaka (JP)

(72) Inventor: Takamichi Mori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/924,370

(22) Filed: Mar. 19, 2018

(65) Prior Publication Data

US 2018/0275542 A1 Sep. 27, 2018

(30) Foreign Application Priority Data

Mar. 24, 2017 (JP) ..... 2017-059166

(51) Int. Cl.
*G03G 9/097* (2006.01)
*G03G 9/08* (2006.01)

(52) U.S. Cl.
CPC ..... *G03G 9/0823* (2013.01); *G03G 9/0819* (2013.01); *G03G 9/09708* (2013.01); *G03G 9/09716* (2013.01); *G03G 9/09725* (2013.01); *G03G 9/09733* (2013.01)

(58) Field of Classification Search
CPC ..... G03G 9/09725; G03G 9/09716; G03G 9/09708; G03G 9/09733; G03G 9/0823
See application file for complete search history.

(56) References Cited

U.S. PATENT DOCUMENTS 5,372,905 A * 12/1994 Deusser ..... B82Y 30/00 430/108.24
6,203,960 B1 * 3/2001 Ciccarelli ..... G03G 9/09716 399/252
6,468,707 B1 * 10/2002 Okuno ..... G03G 9/097 399/252
7,759,036 B2 * 7/2010 Utsumi ..... G03G 9/0804 430/108.1
2009/0311620 A1 * 12/2009 Hirata ..... G03G 9/1136 430/111.1
2010/0232830 A1 * 9/2010 Wada ..... C09B 67/0016 399/111

FOREIGN PATENT DOCUMENTS

JP H11-231571 A 8/1999

* cited by examiner

*Primary Examiner* — Janis L Dote
(74) *Attorney, Agent, or Firm* — Studebaker & Brackett PC

(57) ABSTRACT

A positively chargeable toner includes a plurality of toner particles each including a toner mother particle and external additives adhering to a surface of the toner mother particle. The toner particles of the positively chargeable toner each include a silica particle as one of the external additives and a titania particle as another one of the external additives. The silica particle has on a surface thereof an alkyl group having a carbon number of at least 8 and no greater than 16 and an amino group. The titania particle has an amino group on a surface thereof. The titania particle has a volume resistivity of at least $1.0\times10^{9}$ Ω·cm and no greater than $1.0\times10^{11}$ Ω·cm. The silica particles have an average primary particle diameter larger than that of the titania particles.

8 Claims, No Drawings

POSITIVELY CHARGEABLE TONER

INCORPORATION BY REFERENCE

The present application claims priority under 35 U.S.C. § 119 to Japanese Patent Application No. 2017-059166, filed on Mar. 24, 2017. The contents of this application are incorporated herein by reference in their entirety.

BACKGROUND

The present disclosure relates to a positively chargeable toner including external additives.

A known non-magnetic toner for one-component developer includes two types of hydrophobized silica particles (positively chargeable silica particles and negatively chargeable silica particles) as external additives.

SUMMARY

A positively chargeable toner according to the present disclosure includes a plurality of toner particles each including a toner mother particle and external additives adhering to a surface of the toner mother particle. The toner particles of the positively chargeable toner each include a silica particle as one of the external additives and a titania particle as another one of the external additives. The silica particle has on a surface thereof an alkyl group having a carbon number of at least 8 and no greater than 16 and an amino group. The titania particle has an amino group on a surface hereof. The titania particle has a volume resistivity of at least $1.0\times10^{9}$ Ω·cm and no greater than $1.0\times10^{11}$ Ω·cm. The silica particles have an average primary particle diameter larger than that of the titania particles.

DETAILED DESCRIPTION

The following describes an embodiment of the present disclosure. Unless otherwise stated, evaluation results (values indicating shape or physical properties) for particles (specific examples include toner mother particles, an external additive, a toner, and a carrier) are each a number average of values measured for an appropriate number of the particles.

Unless otherwise stated, a number average particle diameter of particles is a number average value of equivalent circle diameters (Heywood diameters: diameters of circles having the same areas as projected areas of particles) of primary particles measured using a microscope. Unless otherwise stated, a measured value for a volume median diameter ($D_{50}$) of particles is a value measured based on the Coulter principle (electrical sensing zone method) using "Coulter Counter Multisizer 3" manufactured by Beckman Coulter, Inc.

Unless otherwise stated, chargeability refers to chargeability in triboelectric charging. Level of positive chargeability (or level of negative chargeability) in triboelectric charging can for example be confirmed by a known triboelectric series.

In the following description, the term "-based" is appended to the name of a chemical compound to form a generic term encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth) acryloyl" is used as a generic term for both acryloyl ($CH_2{=}CH{-}CO{-}$) and methacryloyl ($CH_2{=}C(CH_3){-}CO{-}$). A crystalline polyester resin is referred to as a "crystalline polyester resin" and a non-crystalline polyester resin is simply referred to as a "polyester resin". The term "amino group" refers to both an unsubstituted amino group ($-NH_2$) and a substituted amino group formed by substitution of a hydrogen atom in the unsubstituted amino group. The term "silyl group" refers to both an unsubstituted silyl group ($-SiH_3$) and a substituted silyl group formed by substitution of a hydrogen atom in the unsubstituted silyl group.

In the present description, non-treated silica particles (hereinafter referred to as a silica base) and silica particles obtained by performing surface treatment on the silica base (surface-treated silica particles) are both referred to as "silica particles". Silica particles treated with a surface treatment agent to be hydrophobic may be referred to as "hydrophobic silica particles". Silica particles treated with a surface treatment agent to be positively chargeable may be referred to as "positively chargeable silica particles". Also, non-treated titania particles (hereinafter referred to as a titania base) and titania particles obtained by performing surface treatment on the titania base (surface-treated titania particles) are both referred to as "titania particles". Titania particles treated with a surface treatment agent to be hydrophobic may be referred to as "hydrophobic titania particles". Titania particles treated with a surface treatment agent to be positively chargeable may be referred to as "positively chargeable titania particles".

The toner according to the present embodiment is a positively chargeable toner and can be favourably used for development of electrostatic latent images. The toner according to the present embodiment includes a plurality of toner particles (particles each having features described below). The toner may be used as a one-component developer. Alternatively, the toner may be mixed with a carrier using a mixer (for example, a ball mill) to prepare a two-component developer. A ferrite carrier (ferrite particles) is an example of carriers suitable for image formation. In order to form high-quality images for a long period of time, it is preferable to use magnetic carrier particles each including a carrier core and a resin layer covering the carrier core. In order to ensure that the carrier has a property for sufficiently charging the toner for a long period of time, it is preferable that the resin layer covers the entire surface of the carrier core (that is, no surface region of the carrier core is exposed from the resin layer). In order to make the carrier particles magnetic, the carrier cores may be made from a magnetic material (for example, a ferromagnetic material such as ferrite) or a resin in which magnetic particles are dispersed. Alternatively, magnetic particles may be dispersed in the resin layers covering the carrier cores. Examples of a resin forming the resin layers include at least one resin selected from the group consisting of fluororesins (specific examples include perfluoroalkoxy alkane (PFA) and fluorinated ethylene propylene (FEP)), polyamide-imide resins, silicone resins, urethane resins, epoxy resins, and phenolic resins. In order to form high-quality images, an amount of the toner in the two-component developer is preferably at least 5 parts by mass and no greater than 15 parts by mass relative to 100 parts by mass of the carrier. The carrier preferably has a number average primary particle diameter of at least 20 μm and no greater than 120 μm. Note that a positively chargeable toner included in a two-component developer is positively charged by friction with a carrier.

The toner according to the present embodiment can for example be used for image formation in an electrophotographic apparatus (an image forming apparatus). The following describes an example of image forming methods using an electrophotographic apparatus.

First, an image forming section (for example, a charger and a light exposure device) of the electrophotographic apparatus forms an electrostatic latent image on a photosensitive member (for example, a surface layer of a photosensitive drum) based on image data. Subsequently, a developing device (specifically, a developing device loaded with a developer including a toner) of the electrophotographic apparatus supplies the toner to the photosensitive member to develop the electrostatic latent image formed on the photosensitive member. The toner is charged by friction with a carrier, a development sleeve, or a blade within the developing device before being supplied to the photosensitive member. A positively chargeable toner is positively charged. In a development process, the toner (specifically, the charged toner) on the development sleeve (for example, a surface layer of a development roller within the developing device) located in the vicinity of the photosensitive member is supplied to the photosensitive member to be attached to a part of the electrostatic latent image exposed to light, whereby a toner image is formed on the photosensitive member. The developing device is replenished with toner for replenishment use supplied from a toner container in compensation for the toner consumed in the development process.

In a subsequent transfer process, a transfer device of the electrophotographic apparatus transfers the toner image from the photosensitive member onto an intermediate transfer member (for example, a transfer belt) and further transfers the toner image from the intermediate transfer member onto a recording medium (for example, paper). Thereafter, a fixing device (fixing method: nip fixing using a heating roller and a pressure roller) of the electrophotographic apparatus fixes the toner to the recording medium through application of heat and pressure to the toner. As a result, an image is formed on the recording medium. For example, a full-color image can be formed by superimposing toner images in respective four colors of black, yellow, magenta, and cyan. After the transfer process, the toner left on the photosensitive member is removed by a cleaning member (for example, a cleaning blade). Note that the transfer process may be a direct transfer process by which the toner image on the photosensitive member is directly transferred to the recording medium not via the intermediate transfer member. Also, the fixing process may be a belt fixing process.

The toner according to the present embodiment includes a plurality of toner particles. The toner particles each include a toner mother particle and external additives. The toner mother particle contains a binder resin. The external additives adhere to a surface of the toner mother particle. The toner mother particle may contain one or more internal additives (for example, at least one of a releasing agent, a colorant, a charge control agent, and a magnetic powder) as necessary in addition to the binder resin.

The toner particles included in the toner according to the present embodiment may each be a toner particle that does not include a shell layer (hereinafter referred to as a non-capsule toner particle) or a toner particle that includes a shell layer (hereinafter referred to as a capsule toner particle). The toner mother particle of the capsule toner particle includes a core and the shell layer covering a surface of the core. The core contains the binder resin. The shell layer is substantially formed from a resin. A toner having both heat-resistant preservability and low-temperature fixability can be obtained for example by covering cores that melt at a low temperature with shell layers that are excellent in heat resistance. An additive may be dispersed in the resin forming the shell layer. The shell layer may entirely or partially cover the surface of the core. The toner mother particle of the non-capsule toner particle described below can be used as the core of the capsule toner particle.

The toner according to the present embodiment is a positively chargeable toner having the following features (hereinafter referred to as basic features).

(Basic Features of Toner)

The toner includes a plurality of toner particles each including a toner mother particle and external additives adhering to a surface of the toner mother particle. The toner particles of the toner each include the following silica particle and the following titania particle as the external additives.

The silica particle has on a surface thereof an alkyl group having a carbon number of at least 8 and no greater than 16 and an amino group.

The titania particle has an amino group on a surface thereof. The titania particle has a volume resistivity of at least $1.0\times10^{9}$ Ω·cm and no greater than $1.0\times10^{11}$ Ω·cm.

The silica particles have a number average primary particle diameter larger than that of the titania particles.

A toner in a two-component developer (a carrier and the toner) is charged by friction with the carrier. A positively chargeable toner is positively charged. In order that the toner is sufficiently positively chargeable, it is preferable that a positively chargeable silica particle (an external additive) adheres to the surface of each toner mother particle. Positively chargeable silica particles having high positive chargeability can be obtained by making silica particles have an amino group on surfaces thereof through use of a surface treatment agent (for example, an aminosilane compound). However, such positively chargeable silica particles tend to be excessively positively charged in an environment of low temperature and low humidity. When excessively positively charged silica particles are detached from toner particles, a phenomenon (carrier contamination) in which the silica particles adhere to surfaces of carrier particles tends to be caused by electrostatic attractive force between the silica particles and the carrier particles. When such carrier contamination by the silica particles occurs, a charge-imparting property of the carrier tends to deteriorate. Therefore, the toner tends not to be sufficiently charged by friction with the contaminated carrier. Also, a situation in which the toner is oppositely charged (i.e., negatively charged) tends to occur as a result of friction between a part of a surface of the carrier to which the silica particles adhere and a part of a surface of the toner from which the silica particles are detached. The oppositely-charged toner causes fogging.

In the toner having the above-described basic features, at least one type of alkyl group having a carbon number of at least 8 and no greater than 16 is present, as well as the amino group, on the surfaces of the silica particles (the external additive). The presence of the at least one type of alkyl group having a large carbon number (specifically, at least 8) on the surfaces of the silica particles reduces an SP value of the silica particles, increasing affinity between the toner mother particles and the silica particles. Increased affinity between the toner mother particles and the silica particles results in reduction or prevention of detachment of the silica particles from the toner mother particles. Also, as the carbon number of an alkyl group that is present on the surfaces of the silica particles increases, viscosity of the surfaces of the silica particles increases and bonding strength between the toner mother particles and the silica particles tends to increase. In a configuration in which an alkyl group having an excessively large carbon number is present on the surfaces of the silica particles, fluidity of the toner becomes insufficient.

The silica base typically has a volume resistivity of approximately $1.0\times10^{11}$ Ω·cm. The titania base typically has a volume resistivity of approximately $1.0\times10^{5}$ Ω·cm. Hydrophobic titania particles (titania particles treated with a surface treatment agent to be hydrophobic) typically have a volume resistivity of approximately $1.0\times10^{9}$ Ω·cm. The silica particles typically have an electric resistance higher than that of the titania particles. The electric resistance of inorganic particles tends to be increased by surface treatment.

Silica particles having high electric resistance readily generate charge in triboelectric charging. In a configuration in which the silica particles (the external additive) adhere to the surfaces of the toner mother particles, the toner particles can be readily charged by triboelectric charging. However, in a configuration in which only the silica particles are used as an external additive for the toner particles, a part of the surface of each toner particle where a silica particle is present is locally charged and uniform charging of the entire surfaces of the toner particles tends not to be achieved. Also, in charging of the toner, all silica particles present on the surfaces of the toner mother particles are not necessarily charged uniformly by triboelectric charging, and frequently rubbed silica particles tend to be excessively charged.

In the toner having the above-described basic features, as well as the silica particles (the external additive), the titania particles (the external additive) are present on the surfaces of the toner mother particles. The titania particles have a volume resistivity of at least $1.0\times10^{9}$ Ω·cm and no greater than $1.0\times10^{11}$ Ω·cm. In the toner having the above configuration, the titania particles receive charge generated by the silica particles to prevent excessive charging (overcharging) of the silica particles. The electric resistance of the titania particles is appropriately low. Therefore, the charge readily moves among the titania particles. The charge generated by the silica particles is thought to rapidly diffuse to each of the titania particles. As a result of the silica particles generating a necessary amount of charge and the generated charge being carried by the titania particles over the entire surfaces of the toner particles, uniform charging of the entire surfaces of the toner particles tends to be achieved.

In the toner having the above-described basic features, the silica particles (the external additive) have a number average primary particle diameter larger than that of the titania particles (the external additive). The silica particles protrude more than the titania particles on the surfaces of the toner mother particles. When a two-component developer (a carrier and the toner) including such a toner is stirred, the silica particles come into contact with the carrier (i.e., the silica particles are rubbed against the carrier) more frequently than the titania particles and are readily charged by triboelectric charging. As a result, charge is favourably generated by the silica particles and made uniform by the titania particles as described above.

Further, in the toner having the above-described basic features, the positively chargeable titania particles (the titania particles that have the amino group on the surfaces thereof) adhere to the surfaces of the toner mother particles. As described above, the silica particles (the external additive) having a number average primary particle diameter larger than that of the titania particles (the external additive) come into contact with the carrier (i.e., the silica particles are rubbed against the carrier) more frequently than the titania particles. However, the titania particles also come into contact with (i.e., the titania particles are rubbed against) the carrier though frequency of contact is relatively low. In view of the above, the present inventor found that in a configuration in which positive chargeability of the titania particles is increased by making the titania particles have the amino group on the surfaces thereof and the volume resistivity of the titania particles is increased within a range (specifically, at least $1.0\times10^{9}$ Ω·cm and no greater than $1.0\times10^{11}$ Ω·cm) not impairing the above-described function of uniform charging (i.e., causing smooth movement of the charge over the surfaces of the toner particles), it can be ensured that the toner has sufficient positive chargeability even when an image forming apparatus is activated (for example, activated for the first time in the morning) and when the image forming apparatus is reactivated after being left unused for a certain period of time. In a configuration in which positive chargeability of the titania particles is excessively low, a sufficient charge rise characteristic of the toner cannot be ensured and fogging tends to be caused by the presence of insufficiently charged toner particles in the toner.

As described above, according to the above-described basic features of the toner, sufficient positive chargeability of the toner can be ensured while excessive charging of the toner can be prevented. Also, even when continuous printing is performed using the toner, high-quality images can be continuously formed by preventing occurrence of fogging over a long period of time.

In the toner having the above-described basic features, the titania particles have a volume resistivity of at least $1.0\times10^{9}$ Ω·cm and no greater than $1.0\times10^{11}$ Ω·cm. The electric resistance of the titania particles is appropriately low. The titania particles are thought to be charged more rapidly than the silica particles. Therefore, in order to ensure a sufficient charge rise characteristic of the toner, it is preferable to make a certain amount of the titania particles contribute to triboelectric charging. In view of the above, the present inventor found that in a configuration in which a ratio of the number average primary particle diameter of the silica particles to that of the titania particles is at least 1.1 and no greater than 2.0, the charge rise characteristic of the toner can be improved while sufficient charge amount of the toner can be ensured during continuous printing. In the following description, the ratio of the number average primary particle diameter of the silica particles to that of the titania particles may be referred to as an "external additive particle diameter ratio". The external additive particle diameter ratio can be calculated based on the following expression "external additive particle diameter ratio=(number average primary particle diameter of silica particles)/(number average primary particle diameter of titania particles)". An external additive particle diameter ratio larger than 1.0 indicates that the number average primary particle diameter of the silica particles is larger than that of the titania particles. In the above-described basic features, the external additive particle diameter ratio is particularly preferably at least 1.4 and no greater than 1.9.

As for respective amounts of the silica particles and the titania particles satisfying the above preferable external additive particle diameter ratio (at least 1.1 and no greater than 2.0), it is particularly preferable that an amount of the silica particles is at least 0.5 parts by mass and no greater than 5.0 parts by mass relative to 100 parts by mass of the toner mother particles and an amount of the titania particles is at least 10 parts by mass and no greater than 50 parts by mass relative to 100 parts by mass of the silica particles.

Note that in the toner having the above-described basic features, the volume resistivity of the silica particles present on the surfaces of the toner mother particles is preferably at least $1.0\times10^{14}$ Ω·cm and no greater than $1.0\times10^{16}$ Ω·cm.

In the above-described basic features, the alkyl group having a carbon number of at least 8 and no greater than 16 present on the surfaces of the silica particles is preferably a part of a silyl group (specifically, a substituted silyl group). A silane coupling agent that has an alkyl group having a carbon number of at least 8 and no greater than 16 can be preferably used as a surface treatment agent for making the silica particles have a silyl group that includes the alkyl group having a carbon number of at least 8 and no greater than 16 on the surfaces of the silica particles.

The amino group present on the respective surfaces of the silica particles and the titania particles in the above-described basic features is particularly preferably an unsubstituted amino group (—$NH_2$) or a substituted amino group formed by substitution of a hydrogen atom in the unsubstituted amino group by a methyl group or an ethyl group. Further, the amino group present on the respective surfaces of the silica particles and the titania particles is preferably a part of an aminoalkyl group. A silane coupling agent that has an aminoalkyl group can be preferably used as a surface treatment agent for making the silica particles and the titania particles have an aminoalkyl group on the surface of each of the silica particles and the titania particles.

In a preferable configuration of the above-described basic features, a first group represented by the following formula (1) and a second group represented by the following formula (2) are present on the surfaces of the silica particles and a third group represented by the following formula (2) is present on the surfaces of the titania particles. The second group and the third group may be the same as or different from each other.

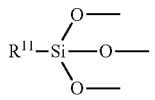

(1)

In formula (1), $R^{11}$ represents an alkyl group having a carbon number of at least 8 and no greater than 16. $R^{11}$ particularly preferably represents a straight alkyl group having a carbon number of at least 8 and no greater than 16. In the first group represented by formula (1), bonds (O—) of oxygen atoms are bonded to the surface of the silica particle.

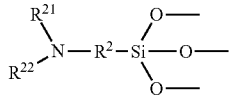

(2)

In formula (2), $R^{21}$ and $R^{22}$ represent, independently of each other, a hydrogen atom or an optionally substituted alkyl group. $R^2$ represents an optionally substituted alkylene group. $R^{21}$ and $R^{22}$ each represent preferably a hydrogen atom, a methyl group, or an ethyl group, and particularly preferably a hydrogen atom. $R^2$ represents preferably an alkylene group having a carbon number of at least 1 and no greater than 8, and more preferably a straight alkylene group having a carbon number of at least 1 and no greater than 4. In the second group represented by formula (2), bonds (O—) of oxygen atoms are bonded to the surface of the silica particle. In the third group represented by formula (2), bonds (O—) of oxygen atoms are bonded to the surface of the titania particle.

A surface treatment agent as represented by the following formula (3) can for example be used for surface treatment on silica particles to make the silica particles have the first group represented by formula (1) on surfaces thereof.

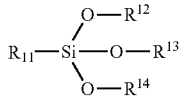

(3)

In formula (3), $R^{11}$ represents the same group as that represented by $R^{11}$ in formula (1). $R^{12}$, $R^{13}$, and $R^{14}$ each represent, independently of one another, a methyl group or an ethyl group.

More specifically, a silane coupling agent as represented by the following formula (F-1) (specifically, n-octyltriethoxysilane) can be used for surface treatment on silica particles to make the silica particles have the first group including a straight alkyl group having a carbon number of 8 (i.e., an n-octyl group) on the surfaces thereof.

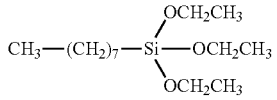

(F-1)

A surface treatment agent as represented by the following formula (4) can for example be used for surface treatment on silica particles to make the silica particles have the second group represented by formula (2) on surfaces thereof. Also, the surface treatment agent as represented by the following formula (4) can for example be used for surface treatment on titania particles to make the titania particles have the third group represented by formula (2) on surfaces thereof.

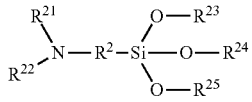

(4)

In formula (4), $R^{21}$, $R^{22}$, and $R^2$ represent the same groups as those represented by $R^{21}$, $R^{22}$, and $R^2$ in formula (2), respectively. $R^{23}$, $R^{24}$, and $R^{25}$ each represent, independently of one another, a methyl group or an ethyl group.

More specifically, a silane coupling agent as represented by the following formula (F-2) (specifically, 3-aminopropyltrimethoxysilane) can be used for surface treatment on silica particles to make the silica particles have the second group including an aminoalkyl group (specifically, an aminopropyl group) on the surfaces thereof. Also, the silane coupling agent as represented by the following formula (F-2) can be used for surface treatment on titania particles to make the titania particles have the third group including an aminoalkyl group (specifically, an aminopropyl group) on the surfaces thereof.

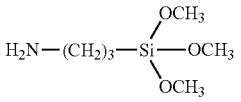

(F-2)

In order to obtain a toner suitable for image formation, the toner mother particles preferably have a volume median diameter ($D_{50}$) of at least 4 μm and no greater than 9 μm.

The following describes a configuration of a non-capsule toner particle. Specifically, a toner mother particle (a binder resin and internal additives) and external additives will be described in the stated order.

[Toner Mother Particle]

The toner mother particle contains the binder resin. The toner mother particle may contain an internal additive (for example, a colorant, a releasing agent, a charge control agent, or a magnetic powder).

(Binder Resin)

The binder resin is typically the major component (for example, at least 85% by mass) of the toner mother particle. Therefore, properties of the binder resin are thought to have great influence on overall properties of the toner mother particle. The properties (specific examples include a hydroxyl value, an acid value, Tg, and Tm) of the binder resin can be adjusted through use of plural resins as the binder resin. The toner mother particle has a strong tendency to be anionic in a configuration in which the binder resin has an ester group, a hydroxyl group, an ether group, an acid group, or a methyl group. The toner mother particle has a strong tendency to be cationic in a configuration in which the binder resin has an amino group.

In order to improve low-temperature fixability of the toner, it is preferable that the toner mother particle contains a thermoplastic resin as the binder resin, and it is more preferable that the thermoplastic resin constitutes at least 85% by mass of the binder resin contained in the toner mother particle. Examples of thermoplastic resins that can be contained in the toner mother particle include styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyester resins, polyamide resins, and urethane resins. Copolymers of the above-listed resins, that is, copolymers formed by introduction of a repeating unit into the above-listed resins (specific examples include styrene-acrylic acid-based resins and styrene-butadiene-based resins) are also preferable as the binder resin of the toner mother particle. The toner mother particle may contain a thermosetting resin in addition to the thermoplastic resin.

In order to improve low-temperature fixability of the toner, it is particularly preferable that the toner mother particle contains a polyester resin or a styrene-acrylic acid-based resin as the binder resin. Also, the toner mother particle may contain a crystalline polyester resin as the binder resin.

A polyester resin is obtained through condensation polymerization of at least one polyhydric alcohol (specific examples include aliphatic diols, bisphenols, and tri- or higher-hydric alcohols listed below) and at least one polybasic carboxylic acid (specific examples include dibasic carboxylic acids and tri- or higher-basic carboxylic acids listed below). The polyester resin may include a repeating unit derived from another monomer (a monomer other than the polyhydric alcohols and the polybasic carboxylic acids).

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids (specific examples include phthalic acid, terephthalic acid, and isophthalic acid), α,ω-alkanedicarboxylic acids (specific examples include malonic acid, succinic acid, adipic acid, suberic acid, azelaic acid, sebacic acid, and 1,10-decanedicarboxylic acid), unsaturated dicarboxylic acids (specific examples include maleic acid, fumaric acid, citraconic acid, itaconic acid, and glutaconic acid), and cycloalkane carboxylic acids (specific examples include cyclohexane dicarboxylic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A styrene-acrylic acid-based resin is a copolymer of at least one styrene-based monomer and at least one acrylic acid-based monomer. Styrene-based monomers and acrylic acid-based monomers listed below can for example be preferably used for synthesis of the styrene-acrylic acid-based monomer.

Preferable examples of styrene-based monomers that can be used include styrene, alkylstyrenes (specific examples include α-methylstyrene, m-methylstyrene, p-methylstyrene, p-ethylstyrene, and 4-tert-butylstyrene), and halogenated styrenes (specific examples include α-chlorostyrene, o-chlorostyrene, m-chlorostyrene, and p-chlorostyrene).

Preferable examples of acrylic acid-based monomers that can be used include (meth)acrylic acid, (meth)acrylonitrile, and (meth)acrylic acid alkyl esters. Preferable examples of the (meth)acrylic acid alkyl esters include methyl (meth) acrylate, ethyl (meth)acrylate, n-propyl (meth)acrylate, isopropyl (meth)acrylate, n-butyl (meth)acrylate, iso-butyl (meth)acrylate, and 2-ethylhexyl (meth)acrylate.

In order that the toner has both heat-resistant preservability and low-temperature fixability, it is preferable that the binder resin (in a configuration in which the toner mother particle contains plural binder resins, a binder resin contained in the largest amount on mass basis) has a glass transition point (Tg) of at least 50° C. and no greater than 65° C.

In order to obtain a toner suitable for image formation, it is preferable that the binder resin (in a configuration in which the toner mother particle contains plural binder resins, a binder resin contained in the largest amount on mass basis) has a softening point (Tm) of at least 80° C. and no greater than 150° C.

In order to ensure sufficient strength and sufficient fixability of the toner, it is preferable that the binder resin (in a configuration in which the toner mother particle contains plural binder resins, a binder resin contained in the largest amount on mass basis) has a number average molecular weight (Mn) of at least 1,000 and no greater than 2,000 and a molecular weight distribution (a ratio Mw/Mn of a mass average molecular weight (Mw) to the number average molecular weight (Mn)) of at least 20 and no greater than 40.

In order to obtain a toner suitable for image formation, it is preferable that the binder resin (in a configuration in which the toner mother particle contains plural binder resins, a binder resin contained in the largest amount on the mass basis) has an acid value of at least 3.0 mgKOH/g and no greater than 8.5 mgKOH/g.

(Colorant)

The toner mother particle may contain a colorant. A known pigment or dye that matches the color of the toner can be used as the colorant. In order to obtain a toner suitable for image formation, it is preferable that an amount of the colorant is at least 1 part by mass and no greater than 20 parts by mass relative to 100 parts by mass of the binder resin.

The toner mother particle may contain a black colorant. An example of the black colorant is carbon black. Alternatively, the black colorant may be a colorant adjusted to the black color using a yellow colorant, a magenta colorant, and a cyan colorant.

The toner mother particle may contain a non-black colorant such as a yellow colorant, a magenta colorant, or a cyan colorant.

Examples of yellow colorants that can be used include at least one compound selected from the group consisting of condensed azo compounds, isoindolinone compounds, anthraquinone compounds, azo metal complexes, methine compounds, and arylamide compounds. Examples of yellow colorants that can be preferably used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particle may contain a releasing agent. The releasing agent is for example used in order to improve fixability or offset resistance of the toner. In order to improve fixability or offset resistance of the toner, an amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer thereof; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes containing fatty acid ester as a major component such as montanic acid ester wax and castor wax; and waxes in which fatty acid ester is entirely or partially deoxidized such as deoxidized carnauba wax. A releasing agent may be used alone or plural releasing agents may be used in combination.

(Charge Control Agent)

The toner mother particle may contain a charge control agent. The charge control agent is for example used in order to improve charge stability or the charge rise characteristic of the toner. The charge rise characteristic of the toner is an indicator as to whether or not the toner is chargeable to a specific charge level in a short period of time.

Anionic strength of the toner mother particle can be increased by inclusion of a negatively chargeable charge control agent (specific examples include organic metal complexes and chelate compounds) in the toner mother particle. Cationic strength of the toner mother particle can be increased by inclusion of a positively chargeable charge control agent (specific examples include pyridine, nigrosine, and quaternary ammonium salt) in the toner mother particle. However, the toner mother particle need not contain a charge control agent as long as the toner has sufficient chargeability without the charge control agent.

(Magnetic Powder)

The toner mother particle may contain a magnetic powder. Examples of materials of the magnetic powder that can be preferably used include ferromagnetic metals (specific examples include iron, cobalt, nickel, and alloys containing at least one of these metals), ferromagnetic metal oxides (specific examples include ferrite, magnetite, and chromium dioxide), and materials subjected to ferromagnetization (specific examples include carbon materials to which ferromagnetism is imparted by thermal treatment). A magnetic powder may be used alone or plural magnetic powders may be used in combination.

[External Additive]

Unlike the internal additives, an external additive (specifically, a plurality of external additive particles) is not present within the toner mother particle but are selectively present only on the surface of the toner mother particle (a surface layer of each toner particle). The external additive particles can be caused to adhere to the surface of the toner mother particle for example by stirring the toner mother particles and the external additives together. The toner mother particles and the external additive particles do not chemically react with one another. The toner mother particles and the external additive particles bond together physically rather than chemically. Bonding strength between the toner mother particles and the external additive particles can be adjusted by controlling stirring conditions (specific examples include a stirring time and a rotational speed for stirring) and a particle diameter, shape, and surface state of the external additive particles. The toner having the above-described basic features includes silica particles as an external additive and titania particles as an external additive.

The silica particles in the above-described basic features have on surfaces thereof an alkyl group having a carbon number of at least 8 and no greater than 16 and an amino group. A silane compound (a surface treatment agent) that has an alkyl group having a carbon number of at least 8 and no greater than 16 can for example be used to make a silica base have an alkyl group having a carbon number of at least 8 and no greater than 16 on a surface thereof. Such a silane compound is preferably an alkylalkoxysilane that has a straight alkyl group having a carbon number of at least 8 and no greater than 16, and particularly preferably n-octyltriethoxysilane, n-decyltrimethoxysilane, or n-hexadecyltrimethoxysilane. The silica base may be silica particles produced by a dry process (specific examples include combustion and deflagration) or a wet process (specific examples include precipitation, gelation, and sol-gel process).

The titania particles in the above-described basic features have an amino group on surfaces thereof.

A surface treatment agent can be used to make the silica base and the titania base have the amino group on surfaces thereof. The surface treatment agent used for making a base (specifically, the silica base or the titania base) have the amino group on the surface thereof is preferably at least one compound selected from the group consisting of aminosilane compounds, aminoalkylsilane compounds, and amino-modified silicone oils. Through use of such a compound as the surface treatment agent, the base can have on the surface thereof a silyl group that has an amino group at a terminal thereof (specific examples include an aminosilyl group and an aminoalkylsilyl group). Particularly preferable examples of aminoalkylsilane compounds (specifically, aminosilane coupling agents) that can be used for surface treatment of the bases include 3-aminopropyltrialkoxysilanes (specific examples include 3-aminopropyltrimethoxysilane and 3-aminopropyltriethoxysilane), 3-(2-aminoethylamino)propyltrialkoxysilanes (specific examples include 3-(2-aminoethylamino)propyltrimethoxysilane and 3-(2-aminoethylamino)propyltriethoxysilane), 3-(2-aminoethylamino)propyldialkoxymethylsilanes (specific examples include 3-(2-aminoethylamino)propyldimethoxymethylsilane), 3-aminopropyltrialkoxysilanes (specific examples include 3-aminopropyltrimethoxysilane), N-phenyl-3-aminopropyltrialkoxysilanes (specific examples include N-phenyl-3-aminopropyltrimethoxysilane and N-phenyl-3-aminopropyltriethoxysilane), and 3-triethoxysilyl-N-(1,3-dimethylbutylidene)propylamine.

When a silane coupling agent that has an amino group is for example used for surface treatment on a base (specifically, the silica base or the titania base), dehydration condensation is caused between a hydroxyl group of the silane coupling agent (for example, a hydroxyl group generated as a result of an alkoxy group of the silane coupling agent being hydrolyzed by water) and a hydroxyl group present on the surface of the base ("A (base)-OH"+"B (coupling agent)-OH"→"A-O—B"+$H_2O$). As a result of chemical bonding between the base and the silane coupling agent that has the amino group through reaction as above, the base has the amino group on the surface thereof. More specifically, the hydroxyl group present on the surface of the base is substituted by a functional group that includes the amino group at a terminal thereof (specific examples include —O—Si—$(CH_2)_3$—$NH_2$).

The titania particles may be hydrophobized using a hydrophobizing agent.

Examples of silane compounds preferably used as the hydrophobizing agent include alkylhalosilanes (specific examples include trichloro(methyl)silane, dichlorodimethylsilane, chlorotrimethylsilane, and tert-butyldimethylchlorosilane), phenylhalosilanes (specific examples include phenyltrichlorosilane and dichlorodiphenylsilane), vinylhalosilanes (specific examples include vinyltrichlorosilane), tetraalkoxysilanes (specific examples include tetramethoxysilane and tetraethoxysilane), alkylalkoxysilanes (specific examples include trimethoxy(methyl)silane, dimethoxydimethylsilane, triethoxymethylsilane, diethoxydimethylsilane, isobutyltrimethoxysilane, and decyltrimethoxysilane), halogenated alkylalkoxysilanes (specific examples include 3-chloropropyltrimethoxysilane), phenylalkoxysilanes (specific examples include trimethoxyphenylsilane, dimethoxydiphenylsilane, triethoxyphenylsilane, and diphenyldiethoxysilane), vinylalkoxysilanes (specific examples include vinyltrimethoxysilane and vinyltriethoxysilane), silane coupling agents that have a (meth)acryloyl group (specific examples include 3-(trimethoxysilyl)propyl methacrylate), silane coupling agents that have an epoxy group (specific examples include 2-(3,4-epoxycyclohexyl)ethyltrimethoxysilane, 3-glycidyloxypropyltrimethoxysilane, and 3-glycidyloxypropylmethyldiethoxysilane), and silane coupling agents that have a mercapto group (specific examples include 3-mercaptopropyltrimethoxysilane).

Examples of silicone oils preferably used as the hydrophobizing agent include straight silicone oils (specific examples include dimethyl silicone oil, methylphenyl silicone oil, and methylhydrogen silicone oil), reactive modified silicone oils (specific examples include amino-modified silicone oil, epoxy-modified silicone oil, carboxyl-modified silicone oil, mercapto-modified silicone oil, methacrylic acid-modified silicone oil, phenol-modified silicone oil, and alcohol-modified silicone oil), and unreactive modified silicone oils (specific examples include alkyl-modified silicone oil, higher fatty acid-modified silicone oil, fluorine-modified silicone oil, polyether-modified silicone oil, and methylstyryl-modified silicone oil).

The titania particles in the above-described basic features have a volume resistivity of at least $1.0\times10^9$ Ω·cm and no greater than $1.0\times10^{11}$ Ω·cm. In order to obtain titania particles having the above volume resistivity (at least $1.0\times10^9$ Ω·cm and no greater than $1.0\times10^{11}$ Ω·cm) while ensuring sufficient positive chargeability and sufficient hydrophobicity of the toner, it is preferable that nitrogen atoms are present on the surfaces of the titania particles in an amount of at least 0.01% by mass and no greater than 0.60% by mass relative to a mass of the titania particles and carbon atoms are present on the surfaces of the titania particles in an amount of at least 2.00% by mass and no greater than 4.00% by mass relative to the mass of the titania particles. Also, it is preferable that the surfaces of the titania particles are hydrophobized using the above-described hydrophobizing agent.

The silica particles in the above-described basic features have a number average primary particle diameter larger than that of the titania particles. In a preferable example of the toner, the silica particles have a number average primary particle diameter of at least 15 nm and no greater than 40 nm, the titania particles have a number average primary particle diameter of at least 10 nm and no greater than 25 nm, and the external additive particle diameter ratio (the ratio of the number average primary particle diameter of the silica particles to that of the titania particles) is at least 1.4 and no greater than 1.9.

Examples of methods for treating the surface of a base (specifically, the silica base or the titania base) include: a first method of dripping or spraying a hydrophobizing agent toward the base while stirring the base at high speed; and a second method of adding the base into a solution of a hydrophobizing agent while stirring the solution. The hydrophobizing agent may be dissolved in an organic solvent. Alternatively, a commercially available hydrophobizing agent diluted with an organic solvent may be used.

In addition to the silica particles and the titania particles, another type of external additive particles may be used as an external additive. As the other type of external additive particles, organic particles having a number average primary particle diameter of at least 60 nm and no greater than 120 nm and a hydrophobicity degree measured by a methanol wettability method of at least 10% by mass and no greater than 30% by mass are particularly preferable. In a configuration in which appropriately large organic particles adhere to the surfaces of the toner mother particles, the organic particles function as spacers among the toner particles. As a result of the organic particles functioning as the spacers, agglomeration of the toner particles is inhibited. However, in a configuration in which the particle diameter of the organic particles is excessively large, the organic particles tend to be detached from the toner mother particles. Also, in a configuration in which the hydrophobicity degree of the organic particles is excessively low, moisture tends to adhere to the surfaces of the toner mother particles and it is difficult to ensure sufficient positive chargeability of the toner. In a configuration in which the hydrophobicity degree of the organic particles is excessively high, the organic particles have high affinity with the toner mother particles and the organic particles tend to be embedded in the toner mother particles. Organic particles embedded in the toner mother particles hardly function as the spacers.

[Method for Producing Toner]

The following describes an example of methods for producing the toner according to the present embodiment. Preferable examples of methods for producing toner mother particles include a pulverization method and an aggregation method. When the toner mother particles are produced by either of the methods, an internal additive tends to be favourably dispersed in a binder resin. Toners are typically classified into pulverized toners and polymerized toners (also called chemical toners). A toner obtained by the pulverization method belongs to the pulverized toners and a toner obtained by the aggregation method belongs to the polymerized toners.

In an example of the pulverization method, a binder resin, a colorant, a charge control agent, and a releasing agent are initially mixed together. Subsequently, the resultant mixture is melt-kneaded using a melt-kneading apparatus (for example, a single-screw or twin-screw extruder). The resultant melt-kneaded product is then pulverized, and the resultant pulverized product is classified. Through the above, toner mother particles are obtained. Usually, toner mother particles can be produced more easily by the pulverization method than by the aggregation method.

In an example of the aggregation method, a binder resin, a releasing agent, and a colorant each in the form of particulates are initially caused to aggregate in an aqueous medium until aggregated particles of a desired particle diameter are obtained. Through the above, the aggregated particles containing components of the binder resin, the releasing agent, and the colorant are formed. Subsequently, the aggregated particles are heated to cause to coalescence of the components contained in the aggregated particles. As a result, toner mother particles having a desired particle diameter are obtained.

(External Addition)

An external additive is caused to adhere to surfaces of the toner mother particles obtained as described above. Only the silica particles and the titania particles defined by the above-described basic features may be used as the external additives. Alternatively, another external additive (for example, organic particles) may be used together with the silica particles and the titania particles. The external additives can be caused to adhere to the surfaces of the toner mother particles by mixing the toner mother particles and the external additives using a mixer under such conditions that the external additives are not embedded in the toner mother particles. Examples of mixers that can be used include a V-shaped mixer, a Q-shaped mixer, an FM mixer, a Lodige mixer, a multi-purpose mixer, a super mixer, and HYBRIDIZATION SYSTEM (registered Japanese trademark).

A toner including a large number of toner particles can be produced through the processes described above. Note that an unnecessary process may be omitted. For example, in a situation in which a commercially available product can be used directly as a material, a process for preparing the material can be omitted by use of the commercially available product. A large number of toner particles are preferably produced at the same time to produce the toner efficiently. Toner particles produced at the same time are thought to have substantially the same configuration.

EXAMPLES

The following describes examples of the present disclosure. Table 1 shows toners TA-1 to TA-6 and TB-1 to TB-9 (each are a positively chargeable toner) according to the examples and comparative examples. Table 2 shows silica particles $S_A$-1 to $S_A$-7 and $S_B$-1 to $S_B$-2 used in production of the toners shown in Table 1. Table 3 shows titania particles $T_A$-1 to $T_A$-5 and $T_B$-1 to $T_B$-4 used in production of the toners shown in Table 1.

TABLE 1

| | External additive | | | |
|---|---|---|---|---|
| Toner | $SiO_2$ | $TiO_2$ | Particle diameter ratio ($SiO_2/TiO_2$) | Organic |
| TA-1 | $S_A$-1 | $T_A$-1 | 1.4 | No |
| TA-2 | $S_A$-2 | $T_A$-2 | 1.1 | |
| TA-3 | $S_A$-3 | $T_A$-3 | 1.4 | |
| TA-4 | $S_A$-4 | $T_A$-4 | 1.9 | |
| TA-5 | $S_A$-5 | $T_A$-5 | 1.1 | |
| TA-6 | $S_A$-6 | $T_A$-4 | 1.9 | Yes |
| TB-1 | $S_B$-1 | $T_A$-1 | 1.4 | No |
| TB-2 | $S_B$-2 | $T_A$-1 | 1.4 | |
| TB-3 | $S_A$-1 | $T_B$-1 | 1.4 | |
| TB-4 | $S_A$-1 | $T_B$-2 | 1.4 | |
| TB-5 | $S_A$-2 | $T_B$-3 | 1.1 | |
| TB-6 | $S_A$-3 | $T_B$-4 | 1.4 | |
| TB-7 | $S_A$-2 | $T_A$-3 | 0.8 | |
| TB-8 | $S_A$-7 | $T_A$-2 | 0.5 | |
| TB-9 | $S_A$-1 | No | — | |

In Table 1, silica particles (silica particles $S_A$-1 to $S_A$-7, $S_B$-1, and $S_B$-2 shown in Table 2) included as external additives in the respective toners are shown in the column titled "$SiO_2$". In Table 1, titania particles (titania particles $T_A$-1 to $T_A$-5 and $T_B$-1 to $T_B$-4 shown in Table 3) included as external additives in the respective toners are shown in the column titled "$TiO_2$". Note that the toner TB-9 included no titania particle. In the column titled "Organic" in Table 1, whether or not each toner included organic particles as an external additive is indicated ("Yes" indicates that the toner included organic particles and "No" indicates that the toner included no organic particle).

In the column titled "Particle diameter ratio" in Table 1, the external additive particle diameter ratio (specifically, a ratio of a number average primary particle diameter of silica particles to that of titania particles) of each toner is indicated. For example, the toner TA-1 included the silica particles $S_A$-1 having a number average primary particle diameter of 30 nm and the titania particles $T_A$-1 having a number average primary particle diameter of 21 nm. Accordingly, the external additive particle diameter ratio of the toner TA-1 is 1.4 (=30/21).

TABLE 2

| Silica particles | Base | Surface treatment: Hydrophobization | Surface treatment: Impartment of positive chargeability | Particle diameter [nm] |
|---|---|---|---|---|
| $S_A$-1 | A-50 | C8 alkylsilane | Done | 30 |
| $S_A$-2 | A-130 | C8 alkylsilane | Done | 16 |
| $S_A$-3 | A-50 | C10 alkylsilane | Done | 30 |
| $S_A$-4 | O-50 | C10 alkylsilane | Done | 40 |
| $S_A$-5 | A-130 | C16 alkylsilane | Done | 16 |
| $S_A$-6 | O-50 | C10 alkylsilane | Done | 40 |
| $S_A$-7 | A-300 | C8 alkylsilane | Done | 7 |
| $S_B$-1 | A-50 | Silicone oil | Done | 30 |
| $S_B$-2 | A-50 | C4 alkylsilane | Done | 30 |

manufactured by Nippon Aerosil Co., Ltd., surface treatment: not done, number average primary particle diameter: 7 nm).

The silica base O-50 was hydrophilic fumed silica particles ("AEROSIL (registered Japanese trademark) OX50" manufactured by Nippon Aerosil Co., Ltd., surface treatment: not done, number average primary particle diameter: 40 nm).

In Table 2, "Done" in the column titled "Impartment of positive chargeability" under "Surface treatment" indicates that surface treatment (treatment for imparting positive chargeability) was performed using 3-aminopropyltriethoxysilane (product of Dow Corning Toray Co., Ltd.).

In Table 2, "C4 alkylsilane", "C8 alkylsilane", "C10 alkylsilane", "C16 alkylsilane", and "Silicone oil" in the column titled "Hydrophobization" under "Surface treatment" represent the following surface treatment agents.

C4 alkylsilane was isobutyltrimethoxysilane (product of Dow Corning Toray Co., Ltd.).

C8 alkylsilane was n-octyltriethoxysilane (product of Dow Corning Toray Co., Ltd.).

C10 alkylsilane was n-decyltrimethoxysilane (product of Dow Corning Toray Co., Ltd.).

C16 alkylsilane was n-hexadecyltrimethoxysilane (product of Dow Corning Toray Co., Ltd.).

Silicone oil was "KF-96-50CS" (product of Shin-Etsu Chemical Co., Ltd.).

In Table 2, a number average primary particle diameter (unit: nm) of each type of silica particles is indicated in the column titled "Particle diameter".

TABLE 3

| Titania particles | Base | Surface treatment: Hydrophobization | Surface treatment: Impartment of positive chargeability | Volume resistivity [Ω · cm] | N content [% by mass] | C content [% by mass] | Particle diameter [nm] |
|---|---|---|---|---|---|---|---|
| $T_A$-1 | P25 | Done | Done | $1.0 \times 10^{10}$ | 0.30 | 2.20 | 21 |
| $T_A$-2 | P90 | Done | Done | $1.0 \times 10^{10}$ | 0.50 | 3.10 | 14 |
| $T_A$-3 | P25 | Done | Done | $1.0 \times 10^{9}$ | 0.20 | 1.80 | 21 |
| $T_A$-4 | P25 | Done | Done | $1.0 \times 10^{10}$ | 0.25 | 1.60 | 21 |
| $T_A$-5 | P90 | Done | Done | $1.0 \times 10^{9}$ | 0.30 | 2.90 | 14 |
| $T_B$-1 | P25 | Done | Not done | $1.0 \times 10^{10}$ | 0.00 | 2.20 | 21 |
| $T_B$-2 | P25 | Not done | Not done | $1.0 \times 10^{6}$ | 0.00 | 0.00 | 21 |
| $T_B$-3 | P90 | Done | Done | $1.0 \times 10^{8}$ | 0.50 | 0.80 | 14 |
| $T_B$-4 | P25 | Done (C16) | Done | $1.0 \times 10^{12}$ | 0.20 | 4.40 | 21 |

In Table 2, "A-50", "A-130", "A-300", and "O-50" in the column titled "Base" represent the following silica bases A-50, A-130, A-300, and O-50, respectively.

The silica base A-50 was hydrophilic fumed silica particles ("AEROSIL (registered Japanese trademark) 50" manufactured by Nippon Aerosil Co., Ltd., surface treatment: not done, number average primary particle diameter: 30 nm).

The silica base A-130 was hydrophilic fumed silica particles ("AEROSIL (registered Japanese trademark) 130" manufactured by Nippon Aerosil Co., Ltd., surface treatment: not done, number average primary particle diameter: 16 nm).

The silica base A-300 was hydrophilic fumed silica particles ("AEROSIL (registered Japanese trademark) 300"

In Table 3, "P25" and "P90" in the column titled "Base" represent the following titania bases P25 and P90, respectively.

The titania base P25 was titanium oxide particles ("AEROXIDE (registered Japanese trademark) P25" manufactured by Nippon Aerosil Co., Ltd., non-treated dry fumed titanium oxide, number average primary particle diameter: 21 nm).

The titania base P90 was titanium oxide particles ("AEROXIDE (registered Japanese trademark) P90" manufactured by Nippon Aerosil Co., Ltd., non-treated dry fumed titanium oxide, number average primary particle diameter: 14 nm).

In Table 3, "Yes" in the column titled "Hydrophobization" under "Surface treatment" indicates that surface treatment (treatment for imparting hydrophobicity) was performed using vinyltriethoxysilane (product of Dow Corning Toray Co., Ltd.).

In Table 3, "Done" in the column titled "Impartment of positive chargeability" under "Surface treatment" indicates that surface treatment (treatment for imparting positive chargeability) was performed using 3-aminopropyltriethoxysilane (product of Dow Corning Toray Co., Ltd.). Note that "Done (C16)" indicates that surface treatment (treatment for imparting positive chargeability) was performed using n-hexadecyltrimethoxysilane (product of Dow Corning Toray Co., Ltd.).

In Table 3, a number average primary particle diameter (unit: nm) of each type of titania particles is indicated in the column titled "Particle diameter".

The following describes production methods, evaluation methods, and evaluation results of the toners TA-1 to TA-6 and TB-1 to TB-9 in the stated order. In evaluations in which errors may occur, an evaluation value was calculated by calculating an arithmetic mean of an appropriate number of measured values to ensure that any errors were sufficiently small.

[Preparation of Materials]

(External Additive: Production of Silica Particles $S_A$-1 to $S_A$-7, $S_B$-1, and $S_B$-2)

A 10-L mixer vessel was charged with 100 g of a silica base (any of the silica bases A-50, A-130, A-300, and O-50) shown in Table 2, and a nitrogen gas was introduced into the vessel to make a nitrogen atmosphere within the vessel. Subsequently, the internal temperature of the vessel was increased to 100° C. Subsequently, 4.5 parts by mass of a hydrophobizing agent (any of C4 alkylsilane, C8 alkylsilane, C10 alkylsilane, C16 alkylsilane, and silicone oil specified for each type of silica particles) shown in Table 2 and 0.5 parts by mass of 3-aminopropyltriethoxysilane (product of Dow Corning Toray Co., Ltd.) were sprayed toward 100 parts by mass of the silica base within the vessel under conditions of the nitrogen atmosphere and the temperature of 100° C. while stirring the silica base within the vessel. After the spraying, the inside of the vessel was maintained under conditions of the nitrogen atmosphere and the temperature of 100° C. for one hour. Through the above, each of the silica particles $S_A$-1 to $S_A$-7, $S_B$-1, and $S_B$-2 was obtained. The obtained silica particles $S_A$-1 to $S_A$-7, $S_B$-1, and $S_B$-2 had respective number average primary particle diameters indicated in Table 2. The number average primary particle diameters each were a number average value of at least 500 measured values (equivalent circle diameters of primary particles) obtained from projection images of particles captured using a scanning electron microscope (SEM).

(External Additive: Production of Titania Particles $T_A$-1 to $T_A$-5 and $T_B$-1 to $T_B$-4)

A 10-L mixer vessel was charged with 200 g of a titania base (either of the titania bases P25 and P90) shown in Table 3, and a nitrogen gas was introduced into the vessel to make a nitrogen atmosphere within the vessel. Subsequently, the internal temperature of the vessel was increased to 100° C. Subsequently, surface treatment indicated in Table 3 was performed under the conditions of the nitrogen atmosphere and a temperature of 100° C. while the titania base within the vessel was stirred. However, no surface treatment was performed in production of the titania particles $T_B$-2.

In production of the titania particles $T_A$-1 to $T_A$-5 and $T_B$-3, vinyltriethoxysilane (product of Dow Corning Toray Co., Ltd.) and 3-aminopropyltriethoxysilane (product of Dow Corning Toray Co., Ltd.) were sprayed toward 100 parts by mass of the titania base within the vessel, and the inside of the vessel was maintained under conditions of the nitrogen atmosphere and a temperature of 100° C. for one hour. Vinyltriethoxysilane and 3-aminopropyltriethoxysilane were added in such amounts that an N content and a C content indicated in Table 3 were attained.

In production of the titania particles $T_A$-1, 3.8 parts by mass of vinyltriethoxysilane and 1.0 part by mass of 3-aminopropyltriethoxysilane were added relative to 100 parts by mass of the titania base.

In production of the titania particles $T_A$-2, 4.3 parts by mass of vinyltriethoxysilane and 1.2 parts by mass of 3-aminopropyltriethoxysilane were added relative to 100 parts by mass of the titania base.

In production of the titania particles $T_A$-3, 2.3 parts by mass of vinyltriethoxysilane and 0.5 parts by mass of 3-aminopropyltriethoxysilane were added relative to 100 parts by mass of the titania base.

In production of the titania particles $T_A$-4, 2.0 parts by mass of vinyltriethoxysilane and 0.7 parts by mass of 3-aminopropyltriethoxysilane were added relative to 100 parts by mass of the titania base.

In production of the titania particles $T_A$-5, 3.9 parts by mass of vinyltriethoxysilane and 0.7 parts by mass of 3-aminopropyltriethoxysilane were added relative to 100 parts by mass of the titania base.

In production of the titania particles $T_B$-3, 1.0 part by mass of vinyltriethoxysilane and 1.2 parts by mass of 3-aminopropyltriethoxysilane were added relative to 100 parts by mass of the titania base.

In production of the titania particles $T_B$-1, 3.8 parts by mass of vinyltriethoxysilane (product of Dow Corning Toray Co., Ltd.) was sprayed toward 100 parts by mass of the titania base within the vessel, and the inside of the vessel was maintained under conditions of the nitrogen atmosphere and a temperature of 100° C. for one hour.

In production of the titania particles $T_B$-4, 5.0 parts by mass of n-hexadecyltrimethoxysilane (product of Dow Corning Toray Co., Ltd.) and 0.5 parts by mass of 3-aminopropyltriethoxysilane (product of Dow Corning Toray Co., Ltd.) were sprayed toward 100 parts by mass of the titania base within the vessel, and the inside of the vessel was maintained under conditions of the nitrogen atmosphere and a temperature of 100° C. for one hour.

Each type of the titania particles $T_A$-1 to $T_A$-5 and $T_B$-1 to $T_B$-4 was obtained as described above. Each type of the obtained titania particles $T_A$-1 to $T_A$-5 and $T_B$-1 to $T_B$-4 had a number average primary particle diameter, a N (nitrogen) content, and a C (carbon) content indicated in Table 3. For example, the titania particles $T_A$-1 had a number average primary particle diameter of 21 nm. The number average primary particle diameters each were a number average value of at least 500 measured values (equivalent circle diameters of primary particles) obtained from projection images of particles captured using a scanning electron microscope (SEM). Further, an amount of N (nitrogen atoms) and an amount of C (carbon atoms) present on surfaces of the titania particles $T_A$-1 were respectively 0.30% by mass and 2.20% by mass relative to a mass of the titania particles. The N contents and the C contents were measured by respective methods described below.

<Methods for Measuring N Content and C Content>

First, 2 mg of titania particles (measurement target: any type of the titania particles $T_A$-1 to $T_A$-5 and $T_B$-1 to $T_B$-4) were placed in a Sn (tin) vial and measurement was performed under the following conditions using a fully automatic element analyzer ("2400II" manufactured by PerkinElmer Co., Ltd.).

Measurement mode: CHN mode

Combustion temperature (combustion tube): 975° C.

Reduction temperature (reduction tube): 640° C.

When titania particles are completely burned, C, H, and N in the titania particles are formed into $CO_2$, $H_2O$, and NOx, respectively. In the CHN mode, respective amounts of C (carbon element), H (hydrogen element), and N (nitrogen element) in the titania particles can be determined by completely burning the titania particles and measuring generated $CO_2$, $H_2O$, and $N_2$ by frontal chromatography (detector: thermal conductivity detector). When the Sn vial is introduced into the combustion tube of the analyzer heated to 975° C., the combustion temperature becomes at least 1800° C. by highly exothermic reaction of the Sn vial. Further, NOx and the like are reduced within the reduction tube of the analyzer.

From the thus determined mass of N (nitrogen element), an N content (unit: % by mass) of the titania particles was determined based on the following expression "N content of titania particles=100×(mass of N)/(mass of titania particles)". Nitrogen atoms present on the surfaces of the titania particles were derived from an amino group (functional group of a surface treatment agent) present on the surfaces of the titania particles.

Also, from a determined mass of C (carbon element), a C content (unit: % by mass) of the titania particles was determined based on the following expression "C content of titania particles=100×(mass of C)/(mass of titania particles)". Carbon atoms present on the surfaces of the titania particles were derived from a vinyl group (functional group of a surface treatment agent) present on the surfaces of the titania particles.

(Production of Organic Particles)

A glass vessel equipped with a stirrer, a cooling tube, a thermometer, and a nitrogen inlet tube was set in a water bath at a temperature of 80° C. Subsequently, the vessel was charged with 100 parts by mass of ion exchanged water and 5 parts by mass of an emulsifier (DBS: sodium dodecylbenzenesulfonate). Subsequently, 0.2 parts by mass of ammonium persulfate and 20 parts by mass of a monomer mixture (specifically, a mixture of styrene and methyl methacrylate mixed at a molar ratio of 1:1) were each dripped into the vessel at a constant rate over one hour under conditions of a nitrogen atmosphere and the temperature of 80° C. while stirring the vessel contents. Subsequently, the temperature of the vessel contents was increased to 85° C. in the nitrogen atmosphere while stirring the vessel contents, and reaction of the vessel contents was caused for five hours under conditions of the nitrogen atmosphere and a temperature of 85° C. As a result, emulsion including a reaction product (a large number of anionic resin particulates) having a number average primary particle diameter of 70 nm was obtained. Subsequently, the obtained emulsion was cooled, and organic particles were obtained through washing and dehydration. The obtained organic particles had a number average primary particle diameter of 70 nm and a hydrophobicity degree of 18% by mass. The number average primary particle diameter was a number average value of at least 500 measured values (equivalent circle diameters of primary particles) obtained from projection images of particles captured using a scanning electron microscope (SEM). The hydrophobicity degree was measured by the following method.

<Method for Measuring Hydrophobicity Degree>

The hydrophobicity degree of the organic particles was measured by the methanol wettability method (MW method). Specifically, a 200-mL glass beaker was charged with 100 g of ion exchanged water, and then 1 g of a sample (the organic particles) was added into the beaker. Thereafter, methanol was gradually dripped into the beaker while stirring the beaker contents at a rotational speed of 150 rpm using a magnetic stirrer to determine an amount Vm (unit: g) of methanol dripped until the sample (the organic particles) was completely wet and precipitated (completely precipitated). Then, a hydrophobicity degree MW (unit: % by mass) of the sample (the organic particles) was calculated based on the following expression. When the amount Vm of methanol dripped until the sample is completely precipitated is for example 100 g, the hydrophobicity degree MW of the sample is 50% by mass.

$$MW[\%\text{ by mass}]=100\times Vm/(Vm+100)$$

[Method for Producing Toner]

(Production of Toner Mother Particles)

A polyester resin having an acid value of 5.6 mgKOH/g, a softening point (Tm) of 120° C., a glass transition point (Tg) of 56° C., a number average molecular weight (Mn) of 1,500, and a mass average molecular weight (Mw) of 45,000 was prepared as a binder resin. Then, 100 parts by mass of the binder resin (the polyester resin), 4 parts by mass of a colorant (C. I. Pigment Blue 15:3, component: copper phthalocyanine pigment), 1 part by mass of a quaternary ammonium salt ("BONTRON (registered Japanese trademark) P-51" manufactured by ORIENT CHEMICAL INDUSTRIES, Co., Ltd.), and 5 parts by mass of a carnauba wax ("Carnauba Wax No. 1" manufactured by S. Kato & Co.) were mixed using an FM mixer (product of Nippon Coke & Engineering Co., Ltd.).

Subsequently, the resultant mixture was melt-kneaded using a twin-screw extruder ("PCM-30" manufactured by Ikegai Corp.). Thereafter, the resultant kneaded product was cooled. The cooled kneaded product was then pulverized using a pulverizer ("Turbo Mill" manufactured by FREUND-TURBO CORPORATION). The resultant pulverized product was then classified using a classifier ("Elbow Jet" manufactured by Nittetsu Mining Co., Ltd.). As a result, toner mother particles having a volume median diameter ($D_{50}$) of 6.8 μm were obtained.

(External Addition)

First, 100 parts by mass of the toner mother particles (the toner mother particles produced as described above), 1.5 parts by mass of silica particles (any type of the silica particles $S_A$-1 to $S_A$-7 and $S_B$-1 to $S_B$-2 specified for each toner) shown in Table 1, and 0.4 parts by mass of titania particles (any type of the titania particles $T_A$-1 to $T_A$-5 and $T_B$-1 to $T_B$-4 specified for each toner) shown in Table 1 were mixed for five minutes using a 10-L FM mixer (product of Nippon Coke & Engineering Co., Ltd.). However, in production of the toner TB-9, no titania particle was added and 100 parts by mass of the toner mother particles and 1.5 parts by mass of the silica particles $S_A$-1 were mixed.

After the above-described mixing in production of the toner TA-6, 0.6 parts by mass of the organic particles (the organic particles produced as described above) was further added relative to 101.9 parts by mass of the resultant mixture (100 parts by mass of the toner mother particles, 1.5 parts by mass of the silica particles $S_A$-6, and 0.4 parts by mass of the titania particles $T_A$-4) and mixing was further performed for five minutes using the FM mixer.

Through the above mixing, external additives adhered to surfaces of the toner mother particles. Thereafter, the resultant particles were sifted using a 200-mesh sieve (pore size:

75 μm). As a result, each toner (each of the toners TA-1 to TA-6 and TB-1 to TB-9) including a large number of toner particles was obtained.

[Evaluation Methods]

Each sample (each of the toners TA-1 to TA-6 and TB-1 to TB-9) was evaluated by methods described below.

(Preparation of Evaluation Developer)

An evaluation developer (a two-component developer) was prepared by mixing 100 parts by mass of a developer carrier (a carrier for "TASKalfa5550ci" manufactured by KYOCERA Document Solutions Inc.) and 8 parts by mass of the toner (evaluation target: any of the toners TA-1 to TA-6 and TB-1 to TB-9) for 30 minutes using a ball mill. Chargeability and an anti-fogging property of the toner were evaluated as described below using the resultant evaluation developer.

(Chargeability)

A printer ("FS-05100DN" manufactured by KYOCERA Document Solutions Inc.) was used as an evaluation apparatus. The evaluation developer obtained as described above was loaded into a developing device for cyan color in the evaluation apparatus and a toner for replenishment use (evaluation target: any of the toners TA-1 to TA-6 and TB-1 to TB-9) was loaded into a toner container for cyan color in the evaluation apparatus.

Subsequently, as a first printing durability test continuous printing was performed at a coverage rate of 5% on 1,000 sheets of paper (A4-size plain paper) using the evaluation apparatus in an environment at a temperature of 10° C. and a relative humidity of 10%. After the first printing durability test, the developing device was taken out of the evaluation apparatus and the developer (the two-component developer) was taken out of the developing device to measure a charge (hereinafter referred to as a charge $Q_A$) of the toner included in the developer by the following method using a Q/m meter.

<Method for Measuring Charge of Toner>

First, 0.10 g of the developer (the two-component developer: the toner and the carrier) was placed in a measurement cell of the Q/m meter ("MODEL 210HS-1" manufactured by TREK, INC.) and only the toner included in the developer was sucked through a sieve (wire netting) for 10 seconds. Then, a charge (unit: μC/g) of the toner was calculated based on the following expression "(total electric amount (unit: μC) of sucked toner)/(mass (unit: g) of sucked toner)".

After the above-described first printing durability test, and printing of a sample image were performed using the evaluation apparatus, continuous printing as a second printing durability test was further performed at a coverage rate of 5% on 30,000 sheets of paper (A4-size plain paper) using the evaluation apparatus in the environment at the temperature of 10° C. and the relative humidity of 10%. After the second printing durability test, the developing device was taken out of the evaluation apparatus and the developer (the two-component developer) was taken out of the developing device to measure a charge (hereinafter referred to as a charge $Q_B$) of the toner included in the developer by the above-described method using the Q/m meter. Then, a charge change amount ΔQ was calculated based on the following expression "$\Delta Q=|Q_A-Q_B|$". The charge change amount ΔQ was a difference (i.e., an absolute value of the difference) between the charge $Q_A$ and the charge $Q_B$.

A charge $Q_A$ of 20 μC/g or larger was evaluated as "Good" and a charge $Q_A$ smaller than 20 μC/g was evaluated as "Poor".

A charge change amount ΔQ of 5 μC/g or smaller was evaluated as "Good" and a charge change amount ΔQ larger than 5 μC/g was evaluated as "Poor".

(Anti-Fogging Property)

A printer ("FS-05100DN" manufactured by KYOCERA Document Solutions Inc.) was used as an evaluation apparatus. The evaluation developer obtained as described above was loaded into a developing device for cyan color in the evaluation apparatus and the sample (the toner for replenishment use) was loaded into a toner container for cyan color in the evaluation apparatus.

Subsequently, continuous printing as a first printing durability test was performed using the evaluation apparatus at a coverage rate of 2% on 2,000 sheets of paper (A4-size plain paper) in an environment at a temperature of 10° C. and a relative humidity of 10%. After the first printing durability test, continuous printing as a second printing durability test was performed using the evaluation apparatus at a coverage rate of 20% on 1,000 sheets of paper (A4-size plain paper) in the environment at the temperature of 10° C. and the relative humidity of 10%. After the second printing durability test, a sample image including a solid part and a blank part was printed on a recording medium (evaluation paper) using the evaluation apparatus. Subsequently, reflection density was measured for each of the blank part of the sample image printed on the recording medium and a non-printed base paper (i.e., non-printed printing paper) using a reflection densitometer ("SPECTROEYE (registered Japanese trademark)" manufactured by X-Rite Inc.). Then, fogging density was calculated based on the following expression. The thus calculated fogging density will be hereinafter referred to as fogging density $FD_A$.

Fogging density=reflection density of blank part−reflection density of non-printed paper After the first and second printing durability tests and printing of the sample image were performed as described above using the evaluation apparatus, the evaluation apparatus was left to stand for 24 hours in the environment at the temperature of 10° C. and the relative humidity of 10%. Subsequently, a sample image including a solid part and a blank part was printed on a recording medium (evaluation paper) using the evaluation apparatus. Subsequently, reflection density was measured for each of the blank part of the sample image printed on the recording medium and a non-printed base paper (i.e., non-printed printing paper) using the reflection densitometer ("SPECTROEYE" manufactured by X-Rite Inc.). Then, fogging density was calculated based on the expression described above. The thus calculated fogging density will be hereinafter referred to as fogging density $FD_B$.

A fogging density $FD_A$ smaller than 0.010 was evaluated as "Good" and a fogging density $FD_A$ of 0.010 or larger was evaluation as "Poor".

A fogging density $FD_B$ smaller than 0.010 was evaluated as "Good" and a fogging density $FD_B$ of 0.010 or larger was evaluated as "Poor".

[Evaluation Results]

Table 4 shows results of evaluation of chargeability in image formation (the charge $Q_A$), charge stability (the charge change amount ΔQ), replenishment fogging (the fogging density $FD_A$), and post-standing fogging (the fogging density $FD_B$) for each of the toners TA-1 to TA-6 and TB-1 to TB-9.

TABLE 4

| | Toner | Chargeability ($Q_A$) [μC/g] | Charge stability (ΔQ) [μC/g] | Replenishment fogging ($FD_A$) | Post-standing fogging ($FD_B$) |
|---|---|---|---|---|---|
| Example 1 | TA-1 | 23 | 3 | 0.002 | 0.004 |
| Example 2 | TA-2 | 25 | 2 | 0.001 | 0.002 |
| Example 3 | TA-3 | 26 | 3 | 0.001 | 0.001 |
| Example 4 | TA-4 | 24 | 3 | 0.002 | 0.002 |
| Example 5 | TA-5 | 32 | 3 | 0.001 | 0.002 |
| Example 6 | TA-6 | 23 | 4 | 0.002 | 0.004 |
| Comparative example 1 | TB-1 | 33 | 2 | 0.014 | 0.016 |
| Comparative example 2 | TB-2 | 26 | 3 | 0.012 | 0.016 |
| Comparative example 3 | TB-3 | 16 | 5 | 0.003 | 0.012 |
| Comparative example 4 | TB-4 | 22 | 3 | 0.004 | 0.023 |
| Comparative example 5 | TB-5 | 30 | 4 | 0.008 | 0.018 |
| Comparative example 6 | TB-6 | 24 | 4 | 0.020 | 0.018 |
| Comparative example 7 | TB-7 | 13 | 3 | 0.025 | 0.041 |
| Comparative example 8 | TB-8 | 15 | 3 | 0.033 | 0.045 |
| Comparative example 9 | TB-9 | 36 | 8 | 0.018 | 0.018 |

The toners TA-1 to TA-6 (the toners according to Examples 1 to 6) each had the above-described basic features. Specifically, the toners TA-1 to TA-6 each included a plurality of toner particles each including a toner mother particle and external additives. The toner particles each included a silica particle as one of the external additives and a titania particle as another of the external additives. The silica particle had an alkyl group having a carbon number of at least 8 and no greater than 16 and an amino group (see Tables 1 and 2). The titania particle had an amino group on a surface thereof (see Tables 1 and 3). The titania particle had a volume resistivity of at least $1.0\times10^9$ Ω·cm and no greater than $1.0\times10^{11}$ Ω·cm (see Tables 1 and 3). The silica particles had a number average primary particle diameter larger than that of the titania particles. That is, the external additive particle diameter ratio was larger than 1.0 (see Tables 1 to 3).

As shown in Table 4, when image formation was performed using any of the toners TA-1 to TA-6, high-quality images could be continuously formed through sufficient positive chargeability of the toner being ensured, excessive charging of the toner being prevented, and occurrence of fogging being continuously prevented for a long period of time.

What is claimed is:

1. A positively chargeable toner comprising a plurality of toner particles each including a toner mother particle and external additives adhering to a surface of the toner mother particle, wherein the toner particles each include a silica particle as one of the external additives and a titania particle as another one of the external additives, the silica particle having on a surface thereof an alkyl group having a carbon number of at least 8 and no greater than 16 and an amino group, the titania particle having an amino group on a surface thereof, the titania particle has a volume resistivity of at least $1.0\times10^9$ Ω·cm and no greater than $1.0\times10^{11}$ Ω·cm, the silica particles have a number average primary particle diameter larger than that of the titania particles, nitrogen atoms are present on the surfaces of the titania particles in an amount of at least 0.01% by mass and no greater than 0.60% by mass relative to a mass of the titania particles, and carbon atoms are present on the surfaces of the titania particles in an amount of at least 2.00% by mass and no greater than 4.00% by mass relative to the mass of the titania particles.

2. The positively chargeable toner according to claim 1, wherein a ratio of the number average primary particle diameter of the silica particles to that of the titania particles is at least 1.1 and no greater than 2.0.

3. The positively chargeable toner according to claim 2, wherein an amount of the silica particles is at least 0.5 parts by mass and no greater than 5.0 parts by mass relative to 100 parts by mass of the toner mother particles, and an amount of the titania particles is at least 10 parts by mass and no greater than 50 parts by mass relative to 100 parts by mass of the silica particles.

4. The positively chargeable toner according to claim 1, wherein the surfaces of the titania particles are hydrophobized.

5. A positively chargeable toner comprising a plurality of toner particles each including a toner mother particle and external additives adhering to a surface of the toner mother particle, wherein the toner particles each include a silica particle as one of the external additives and a titania particle as another one of the external additives, the silica particle having on a surface thereof an alkyl group having a carbon number of at least 8 and no greater than 16 and an amino group, the titania particle having an amino group on a surface thereof, the titania particle has a volume resistivity of at least $1.0\times10^9$ Ω·cm and no greater than $1.0\times10^{11}$ Ω·cm, the silica particles have a number average primary particle diameter larger than that of the titania particles, and the toner particles each further include an organic particle as another one of the external additives, the organic particles having a number average primary particle diameter of at least 60 nm and no greater than 120 nm and a hydrophobicity degree measured by a methanol wettability method of at least 10% by mass and no greater than 30% by mass.

6. The positively chargeable toner according to claim 1, wherein a first group and a second group are present on the surface of the silica particle and a third group is present on the surface of the titania particle, the first group is represented by a formula (1) shown below, and the second group and the third group are represented, independently of each other, by a formula (2) shown below,

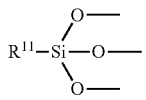

(1)

where in the formula (1), $R^{11}$ represents an alkyl group having a carbon number of at least 8 and no greater than 16, (2)

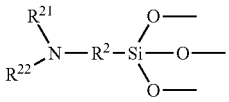

in the formula (2), $R^{21}$ and $R^{22}$ each represent, independently of each other, a hydrogen atom or an optionally substituted alkyl group, and $R^2$ represents an optionally substituted alkylene group.

7. A positively chargeable toner comprising a plurality of toner particles each including a toner mother particle and external additives adhering to a surface of the toner mother particle, wherein the toner particles each include a silica particle as one of the external additives and a titania particle as another one of the external additives, the silica particle having on a surface thereof an alkyl group having a carbon number of at least 8 and no greater than 16 and an amino group, the titania particle having an amino group on a surface thereof, the titania particle has a volume resistivity of at least $1.0\times10^{9}$ Ω·cm and no greater than $1.0\times10^{11}$ Ω·cm, the silica particles have a number average primary particle diameter larger than that of the titania particles, and the silica particle has a volume resistivity of at least $1.0\times10^{14}$ Ω·cm and no greater than $1.0\times10^{16}$ Ω·cm.

8. The positively chargeable toner according to claim 1, wherein the silica particle protrudes more than the titania particle on the surface of the toner mother particle.

* * * * *